US010254673B2

(12) United States Patent
Tsujihiro

(10) Patent No.: US 10,254,673 B2
(45) Date of Patent: Apr. 9, 2019

(54) ELECTROSTATIC LATENT IMAGE DEVELOPING TONER

(71) Applicant: KYOCERA Document Solutions Inc., Osaka (JP)

(72) Inventor: Masami Tsujihiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/547,091

(22) PCT Filed: Mar. 23, 2016

(86) PCT No.: PCT/JP2016/059176

§ 371 (c)(1),
(2) Date: Jul. 28, 2017

(87) PCT Pub. No.: WO2016/152914

PCT Pub. Date: Sep. 29, 2016

(65) Prior Publication Data

US 2018/0024453 A1 Jan. 25, 2018

(30) Foreign Application Priority Data

Mar. 26, 2015 (JP) ..... 2015-064787

(51) Int. Cl.

| | |
|---|---|
| ***G03G 9/087*** | (2006.01) |
| ***G03G 9/093*** | (2006.01) |
| ***G03G 9/08*** | (2006.01) |

(52) U.S. Cl.

CPC ..... *G03G 9/09321* (2013.01); *G03G 9/08* (2013.01); *G03G 9/087* (2013.01); *G03G 9/0821* (2013.01);

(Continued)

(58) Field of Classification Search

CPC ..... G03G 9/08771; G03G 9/09314; G03G 9/087; G03G 9/08755

See application file for complete search history.

(56) References Cited

U.S. PATENT DOCUMENTS

2005/0271964 A1 12/2005 Etou et al.
2015/0004537 A1* 1/2015 Ozawa ..... G03G 9/09328 430/108.21

FOREIGN PATENT DOCUMENTS

JP H03-282556 A 12/1991
JP 2004138985 A 5/2004

(Continued)

OTHER PUBLICATIONS

An Office Action mailed by the Japanese Patent Office dated May 29, 2018, which corresponds to Japanese Patent Application No. 2017-508389 and is related to U.S. Appl. No. 15/547,091.

*Primary Examiner* — Hoa V Le

(74) *Attorney, Agent, or Firm* — Studebaker & Brackett PC

(57) ABSTRACT

A toner contains a plurality of toner particles each including a core and a shell layer disposed over a surface of the core. The core contains a binder resin. The shell layer is substantially formed from a resin having at least one repeating unit including an alcoholic hydroxyl group (specific examples include a repeating unit derived from 2-hydroxyethyl acrylate, 2-hydroxy propyl acrylate, 2-hydroxyethyl methacrylate, and 2-hydroxy propyl methacrylate). A ratio of the repeating unit including the alcoholic hydroxyl group relative to all repeating units in the resin substantially forming the shell layer is at least 0.1% by mass and no greater than 20% by mass.

7 Claims, 1 Drawing Sheet

(52) U.S. Cl.
CPC ..... *G03G 9/08711* (2013.01); *G03G 9/08755* (2013.01); *G03G 9/08791* (2013.01); *G03G 9/08793* (2013.01); *G03G 9/09328* (2013.01); *G03G 9/09371* (2013.01); *G03G 9/09392* (2013.01)

(56) References Cited

FOREIGN PATENT DOCUMENTS

| | | | |
|---|---|---|---|
| JP | 2012-247572 | A | 12/2012 |
| JP | 2013-015555 | A | 1/2013 |

* cited by examiner

ELECTROSTATIC LATENT IMAGE DEVELOPING TONER

TECHNICAL FIELD

The present invention relates to an electrostatic latent image developing toner and particularly relates to a capsule toner.

BACKGROUND ART

Toner particles contained in a capsule toner each include a core and a shell layer (capsule layer) disposed over a surface of the core. In a capsule toner for example disclosed in Patent Literature 1, toner particles each include a toner core having a softening temperature of at least 40° C. and no greater than 150° C.

CITATION LIST

Patent Literature

[Patent Literature 1] Japanese Patent Application Laid-Open Publication No. 2004-138985

SUMMARY OF INVENTION

Technical Problem

However, it is difficult to provide an electrostatic latent image developing toner excellent in durability only through the technique disclosed in Patent Literature 1. Specifically, it is difficult to achieve high-quality image formation over an extended period of time with the toner disclosed in Patent Literature 1.

The present invention has been made in view of the foregoing and has its object of providing an electrostatic latent image developing toner excellent in durability. Another object of the present invention is to provide an electrostatic latent image developing toner having sufficient chargeability even in a high-temperature and high-humidity environment.

Solution to Problem

A toner according to the present invention contains a plurality of toner particles each including a core and a shell layer disposed over a surface of the core. The core contains a binder resin. The shell layer is substantially formed from a resin having at least one repeating unit including an alcoholic hydroxyl group. A ratio of the repeating unit including the alcoholic hydroxyl group relative to all repeating units in the resin substantially forming the shell layer is at least 0.1% by mass and no greater than 20% by mass.

Advantageous Effects of Invention

According to the present invention, an electrostatic latent image developing toner excellent in durability can be provided. Furthermore, according to the present invention, it may be possible that an electrostatic latent image developing toner having sufficient chargeability can be provided even in a high-temperature and high-humidity environment in addition to or in place of the above advantage.

DESCRIPTION OF EMBODIMENTS

Figure 1A:
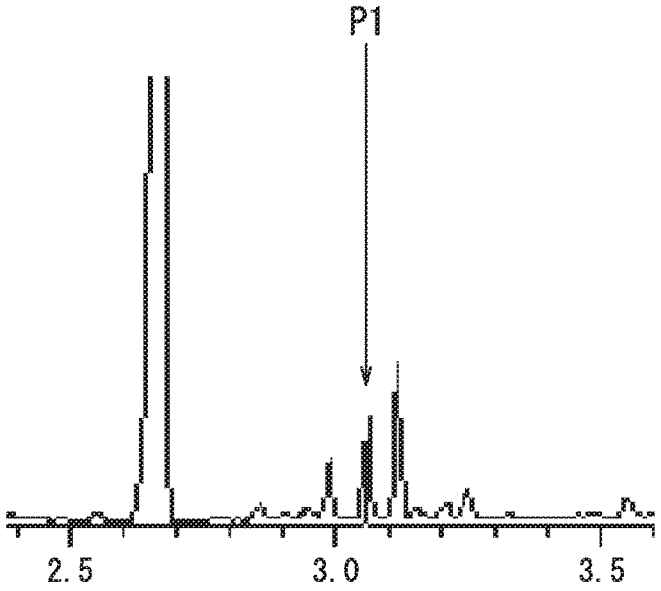
FIG. 1A shows an example of a chromatogram used for obtaining a ratio of a specific hydroxyl group-including unit.

The following describes an embodiment of the present invention in detail. Evaluation results (for example, values indicating shape and physical properties) for a powder (specific examples include toner cores, toner mother particles, an external additive, and a toner) are each a number average of values measured for a suitable number of particles that are selected as average particles within the powder, unless otherwise stated.

A number average particle diameter of a powder is a number average value of equivalent circular diameters of primary particles of the powder (diameters of circles having the same areas as projected areas of the particles) measured using a microscope, unless otherwise stated. Further, a measurement value of a volume median diameter ($D_{50}$) of a powder is a value measured using "Coulter Counter Multisizer 3" produced by Beckman Coulter, Inc. based on Coulter principle (an electric sensing zone method), unless otherwise stated. Furthermore, acid values and hydroxyl values were measured in accordance with Japanese Industrial Standard (JIS) K0070-1992, unless otherwise stated. Values for number average molecular weight (Mn) and mass average molecular weight (Mw) were measured by gel permeation chromatography, unless otherwise stated.

In the following description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. Acrylonitrile and methacrylonitrile may be referred collectively to as "(meth)acrylonitrile". A functional group that may be ionized to form a salt and the salt thereof may be referred collectively to as a "hydrophilic functional group". Examples of the hydrophilic functional group include acid groups (specific examples include a carboxyl group and a sulfo group), hydroxyl groups, and salts of these groups (specific examples include —COONa, —$SO_3$Na, and —ONa). Subscripts "n" of respective repeating units in chemical formulas each represent, independently of one another, the number of repetitions (number of moles) of the repeating unit. Unless otherwise state, n (number of repetitions) is any suitable value.

The toner according to the present embodiment can be preferably used for development of an electrostatic latent image. The toner according to the present embodiment is a powder containing a plurality of toner particles (particles each having a configuration described later). The toner may be used as a one-component developer. Alternatively, a two-component developer may be prepared by mixing the toner with a carrier using a mixer (for example, a ball mill). Ferrite carrier is preferably used as the carrier in order to form a high quality image. Magnetic carrier particles each including a carrier core and a resin layer covering the carrier core are preferably used in order to achieve high quality image formation over an extended period of time. The carrier core may be formed from a magnetic material (for example, ferrite) or a resin in which magnetic particles are dispersed in order to impart magnetism to the carrier particles. Furthermore, the magnetic particles may be dispersed in a resin layer covering the carrier core. The amount of the toner in the two-component developer is preferably at least 5 parts by mass and no greater than 15 parts by mass relative to 100 parts by mass of the carrier in order to form a high quality image, and more preferably at least 8 parts by mass and no greater than 12 parts by mass. Note that a positively chargeable toner contained in a two-component developer is positively charged by friction with the carrier. Also, a negatively chargeable toner contained in a two-component developer is negatively charged by friction with the carrier.

The toner particles contained in the toner according to the present embodiment each include a core (also referred to below as a toner core) and a shell layer (capsule layer) disposed over a surface of the toner core. The shell layer is substantially formed from a resin. An external additive may be caused to adhere to a surface of the shell layer (or a surface region of the toner core that is not covered with the shell layer). The shell layer may cover the entire surface of the toner core or partially cover the surface of the toner core. Two or more shell layers may be layered on the surface of the toner core. In a situation in which an external additive is not necessary, the external additive may be omitted. The term "toner mother particles" used herein refers to toner particles prior to adhesion of an external additive. A material used for forming the toner cores is referred to as a toner core material. Also, a material used for forming the shell layers is referred to as a shell material.

The toner according to the present embodiment can be used for example for image formation in an electrophotographic apparatus (image forming apparatus). The following describes an example of a method by which an electrophotographic apparatus forms an image.

An electrostatic latent image is first formed on a photosensitive member (for example, a surface layer portion of a photosensitive drum) based on image data. Next, the formed electrostatic latent image is developed with a developer that contains a toner. In the developing step, toner (for example, toner charged by friction with a carrier or a blade) on a developing sleeve located in the vicinity of the photosensitive member (for example, a surface layer portion of a development roller in a developing device) is attached to the electrostatic latent image such that a toner image is formed on the photosensitive member. The toner image on the photosensitive member is transferred onto an intermediate transfer member (for example, a transfer belt) in a subsequent transfer step, and then the toner image on the intermediate transfer member is transferred onto a recording medium (for example, paper). Thereafter, the toner is heated in order to fix the toner to the recording medium. As a result, an image is formed on the recording medium. A full-color image can for example be formed by superposing toner images of four different colors: black, yellow, magenta, and cyan.

The toner according to the present embodiment is an electrostatic latent image developing toner having the following configuration (also referred to below as a basic configuration).

(Basic Configuration of Toner)

The toner contains a plurality of toner particles each including a toner core and a shell layer. The toner core contains a binder resin. The shell layer is substantially formed from a resin (also referred to below as a specific hydroxyl group-including resin) having at least one repeating unit (also referred to below as a specific hydroxyl group-including unit) including an alcoholic hydroxyl group. Specifically, it is preferable that at least 90% by mass and no greater than 100% by mass of a resin contained in the shell layer is the specific hydroxyl group-including resin. A ratio of the specific hydroxyl group-including unit relative to all repeating units in the specific hydroxyl group-including resin (also referred to below simply as a "specific hydroxyl group-including unit ratio") is at least 0.1% by mass and no greater than 20% by mass. The measuring method of the specific hydroxyl group-including unit ratio is a method described later in Examples or an alternative method thereof. The specific hydroxyl group-including resin may have two or more types of specific hydroxyl group-including units.

Figure 1B:
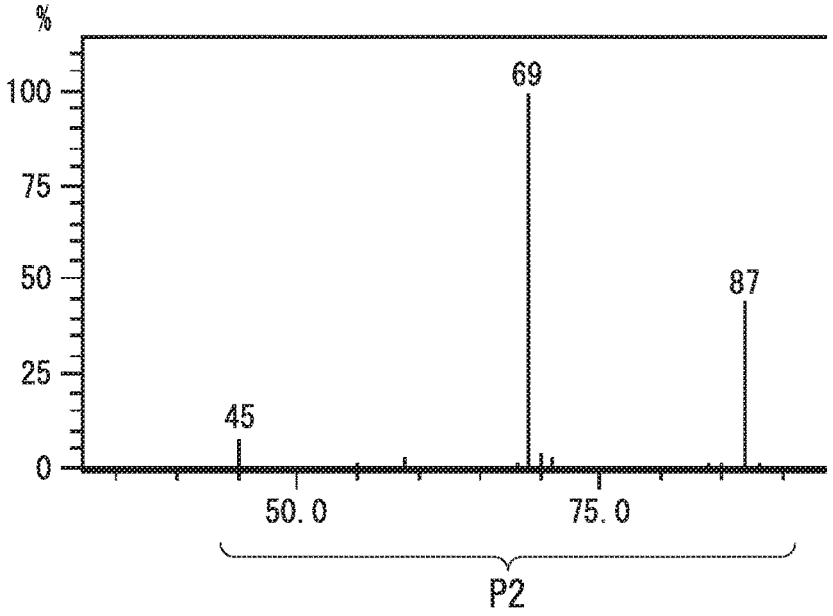
FIG. 1B shows an example of a mass spectrum used for obtaining the ratio of the specific hydroxyl group-including unit.

The specific hydroxyl group-including unit ratio can be measured by GC-MS method. FIG. 1A shows an example of a chromatogram (horizontal axis: time, vertical axis: strength) measured by the GC-MS method. A peak P1 appearing in FIG. 1A is originated from 2-hydroxyethyl methacrylate (HEMA). FIG. 1B shows an example of a mass spectrum (horizontal axis: (mass of ions)/(charge number of ions), vertical axis: strength) measured by the GC-MS method. Peaks P2 (three peaks) appearing in FIG. 1B are each originated from a fragment ion of 2-hydroxyethyl methacrylate (HEMA).

In a configuration for example in which the specific hydroxyl group-including resin is a copolymer of a styrene-based monomer, an acrylic acid-based monomer, and an alcoholic hydroxyl group-including monomer, the specific hydroxyl group-including unit ratio corresponds to a value ($=M_A/M_B$) obtained by dividing a mass $M_A$ of at least one repeating unit derived from the alcoholic hydroxyl group-including monomer (specific hydroxyl group-including unit) by a total mass $M_B$ of at least one repeating unit derive from the styrene-based monomer, at least one repeating unit derived from the acrylic acid-based monomer, and at least one repeating unit derived from the alcoholic hydroxyl group-including monomer. For expressing the value in terms of percentage (% by mass), the calculated value ($=M_A4/M_B$) is multiplied by 100.

In a configuration in which toner particles are almost uniformly mixed in a toner, an equivalent number of the toner particles (for example, 250,000 toner particles) contained in the toner (for example, 50 μg of toner) can be treated as an evaluation sample in a lump. Specifically, a configuration in which the specific hydroxyl group-including unit ratio measured for such an evaluation sample falls in a range defined in the basic configuration (at least 0.1% by mass and no greater than 20% by mass) is thought to be capable of exhibiting advantages described below.

The shell layer is hardly detached from the toner core in the toner having the basic configuration. The reason therefor is thought to be that the alcoholic hydroxyl group of the shell layer chemically reacts with and bonds to the binder resin of the toner core. In a configuration in which the toner core contains a polyester resin as the binder resin in the basic configuration, the shell layer particularly exhibits a tendency to be hardly detached from the toner core. The above tendency is thought to be due to the aforementioned chemical reaction tending to occur between the resins and an increase in affinity through proximity of SP values (solubility parameters) of the respective resins. Inhibition of detachment of the shell layer from the toner core can inhibit adhesion of the toner to a photosensitive drum.

The inventor has found that in addition to the operation and advantages of the toner, the charge amount of the toner particles tends to decrease in a high-temperature and high-humidity environment in configuration in which the amount of alcoholic hydroxyl group contained in the shell layer is too large. The reason therefor is thought to be that the hydrophilicity of the surface of the toner particle is increased to allow the surface of the toner particle to readily adsorb water molecules. The inventor has further found that when the shell layers are formed from a resin having the specific hydroxyl group-including unit at a ratio defined in the basic configuration (at least 0.1% by mass and no greater than 20% by mass), a toner can be obtained that has sufficient chargeability even in a high-temperature and high-humidity environment. Image formation using the toner having sufficient chargeability can result in high-quality image formation. The specific hydroxyl group-including unit ratio is particularly preferably at least 5% by mass and no greater than 10% by mass in order to improve chargeability of the toner in a high-temperature and high-humidity environment.

The specific hydroxyl group-including unit (repeating unit including an alcoholic hydroxyl group) preferably has for example a repeating unit represented by the following formula (1).

(1)

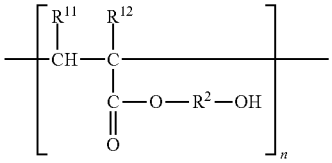

In formula (1). $R^{11}$ and $R^{12}$ each represent, independently of one another, a hydrogen atom, a halogen atom, or an optionally substituted alkyl group. Further, $R^2$ represents an optionally substituted alkylene group. Preferably, $R^{11}$ and $R^{12}$ each represent, independently of one another, a hydrogen atom or a methyl group with a combination of $R^{11}$ representing a hydrogen atom and $R^{12}$ representing a hydrogen atom or a methyl group being particularly preferable. $R^2$ preferably represents an alkylene group having a carbon number of at least 1 and no greater than 6 with an alkylene group having a carbon number of at least 1 and no greater than 4 being more preferable. In a repeating unit derived from 2-hydroxyethyl methacrylate, $R^{11}$ represents a hydrogen atom. $R^{12}$ represents a methyl group, and $R^2$ represents an ethylene group (—$(CH_2)_2$—).

The specific hydroxyl group-including resin forming the shell layer preferably does not contain a repeating unit including at least one of an acid group, a hydroxyl group, and salts of these other than the repeating unit including the alcoholic hydroxyl group in order to sufficiently inhibit adsorption of moisture in the air to the surfaces of the shell layers.

A ratio of a repeating unit including a hydrophilic functional group is preferably no greater than 10% by mass relative to all repeating units in the specific hydroxyl group-including resin forming the shell layer in order to sufficiently inhibit adsorption of moisture in the air to the surface of the shell layers.

Preferably, the specific hydroxyl group-including resin forming the shell layer further has at least one repeating unit derived from a styrene-based monomer in addition to the specific hydroxyl group-including unit in order to improve high-temperature preservability, fixability, and charge stability of the toner. A repeating unit represented by the following formula (2) is particularly preferable as the repeating unit derived from a styrene-based monomer.

(2)

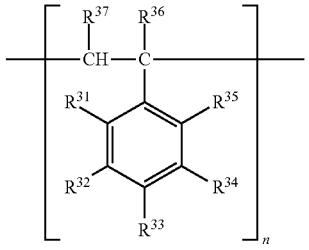

In formula (2). $R^{31}$-$R^{35}$ each represent, independently of one another, a hydrogen atom, a halogen atom, a hydroxyl group, an optionally substituted alkyl group, an optionally substituted alkoxy group, an optionally substituted alkoxy alkyl group, or an optionally substituted aryl group. Further, $R^{36}$ and $R^{37}$ each represent, independently of one another, a hydrogen atom, a halogen atom, or a optionally substituted alkyl group. $R^{31}$-$R^{35}$ each represent, independently of one another, a hydrogen atom a halogen atom, an alkyl group having a carbon number of at least 1 and no greater than 4, an alkoxy group having a carbon number of at least 1 and no greater than 4, or an alkoxy alkyl group having a carbon number (specifically, a total carbon number of alkoxy and alkyl) of at least 2 and no greater than 6. Preferably, $R^{36}$ and $R^{37}$ each represent, independently of one another, a hydrogen atom or a methyl group with a combination of $R^{37}$ representing a hydrogen atom and $R^{36}$ representing a hydrogen atom or a methyl group being particularly preferable. Note that $R^{31}$-$R^{37}$ each represent a hydrogen atom in a repeating unit derived from styrene.

A repeating unit having the highest mole fraction among the repeating units in the specific hydroxyl group-including resin forming the shell layer is preferably a repeating unit derived from a styrene-based monomer (more preferably, the repeating unit represented by formula (2)) in order that the shell layer has sufficiently strong hydrophobicity and appropriate strength.

Preferably, the specific hydroxyl group-including resin forming the shell layer further has at least one repeating unit derived from a (meth)acrylic acid ester in addition to the specific hydroxyl group-including unit and the repeating unit derived from the styrene-based monomer in order to improve high-temperature preservability, fixability, and charge stability of the toner. A repeating unit represented by the following formula (3) is particularly preferable as the repeating unit derived from a (meth)acrylic acid ester.

(3)

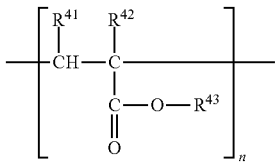

In formula (3), $R^{41}$ and $R^{42}$ each represent, independently of one another, a hydrogen atom, a halogen atom, or an optionally substituted alkyl group. $R^{43}$ represents an optionally substituted alkyl group having a carbon number of at least 1 and no greater than 8. Preferably, $R^{41}$ and $R^{42}$ each represent, independently of one another, a hydrogen atom or a methyl group with a combination of $R^{41}$ representing a hydrogen atom and $R^{42}$ representing a hydrogen atom or a methyl group being particularly preferable. Particularly preferably, $R^{43}$ represents an alkyl group having a carbon number of at least 4 and no greater than 6. In a repeating unit derived from butyl acrylate, $R^{41}$ and $R^{42}$ each represent a hydrogen atom and $R^{43}$ represents a butyl group (alkyl group having a carbon number of 4).

The shell layer may further contain a thermosetting resin (for example, a hydrophilic thermosetting resin) in addition to the specific hydroxyl group-including resin in order to increase strength of the shell layers. The thermosetting resin preferably occupies no greater than 10% by mass among resins contained in the shell layer in order to improve both charge stability and high-temperature preservability of the toner, and more preferably at least 0.01% by mass and no greater than 5% by mass.

The shell layer preferably has a thickness of at least 1 nm and no greater than 30 nm in order to improve both high-temperature preservability and low-temperature fixability of the toner. The thickness of the shell layers can be measured by analyzing a cross-sectional TEM image of the toner particles using commercially available image analysis software (for example. WinROOF produced by Mitani Corporation). Note that if the thickness of the shell layer is not uniform for a single toner particle, the thickness of the shell layer is measured at each of four locations that are evenly spaced (specifically, four locations at which the shell layer intersects with two orthogonal straight lines intersecting with each other at substantially the center of the cross section of the toner particle) and the arithmetic mean of the four measured values is determined to be an evaluation value (thickness of shell layer) for the toner particle.

Preferably, the shell layer covers at least 50% and no greater than 99% of the surface area of the toner core in order to improve both high-temperature preservability and low-temperature fixability of the toner, and more preferably at least 70% and no greater than 95%.

The toner core (the binder resin and an internal additive), the shell layer, and the external additive will be described next in order. An unnecessary component may be omitted according to use of the toner.

<Preferable Thermoplastic Resin>

Preferable examples of the thermoplastic resin forming the toner particle (particularly, the toner core and the shell layer) include styrene-based resins, acrylic acid-based resins (specific examples include an acrylic acid ester polymer and a methacrylic acid ester polymer), olefin-based resins (specific examples include a polyethylene resin and a polypropylene resin), vinyl chloride resins, polyvinyl alcohol, vinyl ether resins, N-vinyl resins, polyester resins, polyamide resins, and urethane resins. Alternatively, a copolymer of two or more of the resins listed above, that is, a copolymer of a resin among the resins listed above into which any repeating unit is introduced (specific examples include a styrene-acrylic acid-based resin or a styrene-butadiene-based resin) can be preferably used.

A thermoplastic resin can be yielded by addition polymerization, copolymerization, or condensation polymerization of at least one thermoplastic monomer. The thermoplastic monomer is a monomer that forms a thermoplastic resin through homopolymarization (specific examples include acrylic acid-based monomers and styrene-based monomers) or a monomer that forms a thermoplastic resin through condensation polymerization (for example, a polyester resin is formed through condensation polymerization of a combination of a polyhydric alcohol and a polybasic carboxylic acid).

The styrene-acrylic acid-based resin is a copolymer of at least one styrene-based monomer and at least one acrylic acid-based monomer. Any of styrene-based monomers and acrylic acid-based monomers listed below for example can be preferably used for synthesis of a styrene-acrylic acid-based resin. Use of an acrylic acid-based monomer including a carboxyl group can result in introduction of the carboxyl group into the styrene-acrylic acid-based resin. Further, use of a monomer including a hydroxyl group (specific examples include p-hydroxystyrene, m-hydroxystyrene, and (meth)acrylic acid hydroxyalkyl ester) can result in introduction of the hydroxyl group into the styrene-acrylic acid-based resin. An acid value of the styrene-acrylic acid-based resin yielded can be adjusted by adjusting the used amount of the acrylic acid-based monomer. The hydroxyl value of the styrene-acrylic acid-based resin yielded can also be adjusted through adjustment of the used amount of the monomer having the hydroxyl group.

Preferable examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic acid-based monomer include (meth)acrylates, (meth)acrylonitriles, alkyl (meth) acrylates, and (meth)acrylic acid hydroxyalkyl esters. Preferable examples of alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Preferable examples of (meth)acrylic acid hydroxyalkyl esters include 2-hydroxyethyl (meth)acrylate, 3-hydroxypropyl (meth)acrylate, 2-hydroxypropyl (meth)acrylate, and 4-hydroxybutyl (meth)acrylate.

The polyester resin can be prepared through condensation polymerization of at least one polyhydric alcohol and at least one polybasic carboxylic acid. Examples of the alcohol that can be preferably used for synthesis of the polyester resin include dihydric alcohols (specific examples include diols and bisphenols) and tri- or higher-hydric alcohols listed below. Examples of the carboxylic acid that can be preferably used for synthesis of the polyester resin include dibasic carboxylic acids and tri- or higher-basic carboxylic acids listed below. The acid value and the hydroxyl value of the polyester resin can be adjusted through adjustment of the respective amounts of the alcohol and the carboxylic acid used for synthesis of the polyester resin. Increasing the molecular weight of the polyester resin tends to decrease the acid value and the hydroxyl value of the polyester resin.

Preferable examples of the diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaeythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Note that any of the di-, tri-, or higher-basic carboxylic acids listed above may be deformed into an ester-forming derivative (more specifically, acid halide, acid anhydride, or lower alkyl ester) for use. The term "lower alkyl" herein refers to an alkyl group having a carbon number of at least 1 and no greater than 6.

<Preferable Thermosetting Resin>

Examples of the thermosetting resin forming the toner particles (particularly, the shell layers) that can be preferably used include melamine-based resins, urea-based resins, sulfonamide-based resins, glyoxal-based resins, guanamine-based resins, aniline-based resins, polyimide resins (specific examples include a maleinimide polymer and a bismaleimide polymer), and xylene-based resins.

The thermosetting resin can be prepared through crosslinking reaction (polymerization) of at least one thermosetting monomer. Alternatively, the thermosetting resin can be synthesized from a thermoplastic monomer using a crosslinking agent. Note that the thermosetting monomer is a crosslinkable monomer. For example, in a situation in which monomers of the same species are three-dimensionally linked via "—$CH_2$—" to become a thermosetting resin, the monomers and the "thermosetting monomers" are equivalent.

Preferable examples of the thermosetting monomer include methylol melamine, melamine, methylol ureas (a specific example is dimethylol dihydroxyethyleneurea), urea, benzoguanamine, acetoguanamine, and spiroguanamine.

[Toner Core]

The toner core contains a binder resin. The toner core may optionally contain an internal additive (for example, a colorant, a releasing agent, a charge control agent, and a magnetic powder).

(Binder Resin)

The binder resin is typically a main component (for example, at least 85% by mass) of the toner core. Properties of the binder resin are therefore thought to have a great influence on properties of the toner core as a whole. For example, the toner core is highly likely to be anionic in a configuration in which the binder resin includes an ester group, a hydroxyl group, an ether group, an acid group, or a methyl group. By contrast, the toner core is highly likely to be cationic in a configuration in which the binder resin includes an amino group or an amide group. At least one of the hydroxyl value and the acid value of the binder resin is preferably at least 10 mgKOH/g in order to increase reactivity between the toner cores and the shell layers, and more preferably at least 20 mgKOH/g.

The binder resin preferably includes one or more chemical group selected from the group consisting of ester groups, hydroxyl groups, ether groups, acid groups, and methyl groups. More preferably, the binder resin includes either or both of a hydroxyl group and a carboxyl group. A binder resin including a functional group such as above tends to react with and chemically bond to a shell material. Such chemical bonds ensure strong bonding between the core and the shell layer. Also, the binder resin preferably includes an activated hydrogen-containing functional group in molecules thereof.

The binder resin preferably has a glass transition point (Tg) of at least 20° C. and no greater than 55° C. in order to improve fixability of the toner in high speed fixing. The method for measuring the glass transition point (Tg) is the same as that described later in Examples or an alternative method thereof.

The binder resin preferably has a softening point (Tm) of no greater than 100° C. in order to improve fixability of the toner in high speed fixing, and more preferably no greater than 95° C. In a configuration in which the binder resin has a Tm of no greater than 100° C. (more preferably, 95° C.), partial softening of the toner core tends to occur during curing reaction of the shell layers in formation of the shell layers on the surfaces of the toner cores in an aqueous medium. As a result, the toner cores tend to become round in shape due to surface tension. The method for measuring the softening point (Tm) is the same as that described later in Examples or an alternative method thereof. Tm of the binder resin can be adjusted by using a combination of a plurality of resins that each have a different Tm.

Any thermoplastic resin (specific examples include those listed in "Preferable Thermoplastic Resin" above) is preferable as the binder resin of the toner core. A styrene-acrylic-based resin or a polyester resin is particularly favorably used as the binder resin in order to improve dispersibility of a colorant in the toner cores, chargeability of the toner, and fixability of the toner to a recording medium.

In a configuration in which a styrene-acrylic acid-based resin is used as the binder resin of the toner cores, the styrene-acrylic acid-based resin preferably has a number average molecular weight (Mn) of at least 2,000 and no greater than 3,000 in order to improve strength of the toner cores and fixability of the toner. The styrene-acrylic acid-based resin preferably has a molecular weight distribution (ratio Mw/Mn of mass average molecular weight (Mw) relative to number average molecular weight (Mn)) of at least 10 and no greater than 20.

In a configuration in which a polyester resin is used as the binder resin of the toner core, the polyester resin preferably has a number average molecular weight (Mn) of at least 1,000 and no greater than 2,000 in order to improve the strength of the toner cores and the fixability of the toner. The polyester resin preferably has a molecular weight distribution (ratio Mw/Mn of mass average molecular weight (Mw) relative to number average molecular weight (Mn)) of at least 9 and no greater than 21.

(Colorant)

The toner cores may optionally contain a colorant. A known pigment or dye that match the color of the toner can be used as the colorant. The amount of the colorant is preferably at least 1 part by mass and no greater than 20 parts by mass relative to 100 parts by mass of the binder resin in order to form a high-quality image with the toner, and more preferably at least 3 parts by mass and no greater than 10 parts by mass.

The toner core may contain a black colorant. The black colorant is for example carbon black. Alternatively, the black colorant may be a colorant that is adjusted to a black color using a yellow colorant, a magenta colorant, and a cyan colorant.

The toner core may contain a non-black colorant such as a yellow colorant, a magenta colorant, or a cyan colorant.

At least one compound selected from the group consisting of condensed azo compounds, isoindolinone compounds, anthraquinone compounds, azo metal complexes, methine compounds, and arylamide compounds can be used as the yellow colorant. Examples of a yellow colorant that can be preferably used include C.I. Pigment Yellow (3, 12, 13, 14, 15, 17, 62, 74, 83, 93, 94, 95, 97, 109, 110, 11, 120, 127, 128, 129, 147, 151, 154, 155, 168, 174, 175, 176, 180, 181, 191, and 194), Naphthol Yellow S, Hansa Yellow G and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used as the magenta colorant. Examples of a magenta colorant that can be preferably used include C.I. Pigment Red (for example, 2, 3, 5, 6, 7, 19, 23, 48:2, 48:3, 48:4, 57:1, 81:1, 122, 144, 146, 150, 166, 169, 177, 184, 185, 202, 206, 220, 221, and 254).

At least one compound selected from the group consisting of copper phthalocyanine compounds, anthraquinone compounds, and basic dye lake compounds can be used as the cyan colorant. Examples of a cyan colorant that can be preferably used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner core may optionally contain a releasing agent. The releasing agent is for example used in order to improve fixability of the toner or resistance of the toner to being offset. The toner cores are preferably prepared using an anionic wax in order to increase the anionic strength of the toner cores. The amount of the releasing agent is preferably at least 1 part by mass and no greater than 30 parts by mass relative to 100 parts by mass of the binder resin in order to improve fixability or offset resistance of the toner, and more preferably at least 5 parts by mass and no greater than 20 parts by mass.

Examples of a releasing agent that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One of the releasing agents listed above may be used alone or two or more of the releasing agents listed above may be used in combination.

A compatibilizer may be added to the toner core in order to improve compatibility between the binder resin and the releasing agent.

(Charge Control Agent)

The toner core may optionally contain a charge control agent. The charge control agent is for example used in order to improve charge stability or a charge rise characteristic of the toner. The charge rise characteristic of the toner is an indicator as to whether the toner can be charged to a specific charge level in a short period of time.

Anionic strength of the toner cores can be increased by including a negatively chargeable charge control agent in the toner cores. Cationic strength of the toner cores can be increased by including a positively chargeable charge control agent in the toner cores. However, there is no need to use a charge control agent for the toner cores if sufficient chargeability of the toner can be ensured.

(Magnetic Powder)

The toner core may optionally contain a magnetic powder. Examples of a material of a magnetic powder that can be preferably used include ferromagnetic metals (specific examples include iron, cobalt, nickel, and alloy containing at least one of the listed metals), oxides of ferromagnetic metals (specific examples include ferrite, magnetite, and chromium dioxide), and materials subjected to ferromagnetization (specific examples is a carbon material to which ferromagnetism is imparted through thermal treatment). One type of the magnetic powders listed above may be used alone, or plural types of the magnetic powders listed above may be used in combination.

The magnetic powder is preferably subjected to surface treatment in order to inhibit elution of metal ions (for example, iron ions) from the magnetic powder. In a situation in which the shell layers are formed on the surfaces of the toner cores under acidic conditions, elution of metal ions to the surfaces of the toner cores causes the toner cores to adhere to one another more readily. It is thought that adhesion of the toner cores to one another can be inhibited by inhibiting elution of the metal ions from the magnetic powder.

[Shell Layer]

The shell layer in the toner having the above basic configuration is substantially formed from the specific hydroxyl group-including resin. The shell layer may optionally contain a trace amount of a thermosetting resin (specific examples include those listed in "Preferable Thermosetting Resin" above) in addition to the specific hydroxyl group-including resin. The shell layer preferably contains at least one thermosetting resin selected from the group consisting of melamine-based resins, urea-based resins, and glyoxal-based resins in order to improve both charge stability and high-temperature preservability of the toner.

The specific hydroxyl group-including resin in the basic configuration is preferably a thermoplastic resin into which the specific hydroxyl group-including unit is introduced (specific examples include those listed in "Preferable Thermoplastic Resin" above) in order to inhibit detachment of the shell layers from the toner cores. Furthermore, at least one of the repeating units including an alcohol hydroxyl group (specific hydroxyl group-including unit) in the basic configuration is preferably a repeating unit derived from 2-hydroxyethyl acrylate (HEA), 2-hydroxy propyl acrylate (HPA), 2-hydroxyethyl methacrylate (HEMA), or 2-hydroxy propyl methacrylate (HPMA) in order to inhibit detachment of the shell layers from the toner cores. The glass transition point (Tg) of the shell layers hardly lowers even in a configuration in which a repeating unit derived from HEA or the like is incorporated into the resin forming the shell layers.

Preferable examples of the specific hydroxyl group-including resin in the basic configuration include copolymers of at least one styrene-based monomer (for example, styrene), at least one (meth)acrylic acid ester (for example, butyl acrylate), and at least one alcoholic hydroxyl group-including monomer (for example, 2-hydroxyethyl methacrylate). A copolymer such as above is likely to be positively charged and has comparatively strong hydrophobicity. Chargeability of the toner in a high-temperature and high-humidity environment can be improved by including a resin such as above (one of the copolymers listed above) in the shell layers. Further, the copolymer may have a cross-linking structure originated from a cross-linking agent to increase strength of the shell layers. For example, the copolymer may have a cross-linking structure originated from divinylbenzene.

[External Additive]

An external additive may be caused to adhere to the surfaces of toner mother particles. For example, the external additive is caused to adhere (physically bond) to the surfaces of the toner mother particles by physical power through stirring the external additive together with the toner mother particles. The external additive is used for example in order to improve fluidity or handleability of the toner. The amount of the external additive is preferably at least 0.5 parts by mass and no greater than 10 parts by mass relative to 100 parts by mass of the toner mother particles in order to improve fluidity or handleability of the toner. Furthermore, the external additive preferably has a particle diameter of at least 0.01 μm and no greater than 1.0 μm in order to improve fluidity or handleability of the toner.

Inorganic particles are preferable as the external additive, and silica particles or particles of metal oxides (specific examples include alumina, titanium oxide, magnesium oxide, zinc oxide, strontium titanate, and barium titanate) are particularly preferable. However, resin particles may be used as the external additive. One of the external additives listed above may be used alone or two or more of the external additives listed above may be used in combination.

[Toner Production Method]

The following describes an example of a method for producing the toner having the above configuration according to the present embodiment. Toner cores are prepared first. Subsequently, the toner cores and a shell material are put in a liquid. Preferably, the shell material is then dissolved or dispersed in the liquid for example by stirring the liquid. The shell layers are then formed on the surfaces of the toner cores in the liquid (shell layers are hardened). In order to inhibit dissolution or elution of toner core components (particularly, a binder resin and a releasing agent) during formation of the shell layers, formation of the shell layers is preferably carried out in an aqueous medium. For the reason as above, a water-soluble shell material (for example, water-soluble monomer) is preferably used for shell layer formation. The aqueous medium refers to a medium containing water as a main component (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of a polar medium that can be used in the aqueous medium include alcohols (specific examples include methanol and ethanol).

The method for producing the toner according to the present embodiment will be described below further in detail through a more specific example.

(Toner Cores Preparation)

For easy preparation of preferable toner cores, the toner cores are preferably produced by aggregation method or pulverization method with the pulverization method being more preferable.

The following describes an example of the pulverization method. A binder resin and an internal additive (for example, at least one of a colorant, a releasing agent, a charge control agent, and a magnetic powder) are mixed together first. Subsequently, the resultant mixture is melted and kneaded. Subsequently, the resultant kneaded product is pulverized and classified. As a result, toner cores having a desired particle diameter are produced.

The following describes an example of the aggregation method. Respective fine particles of a binder resin, a releasing agent, and a colorant are caused to aggregate in an aqueous medium first to yield aggregated particles containing the binder resin, the releasing agent, and the colorant. The resultant aggregated particles are then heated to coalesce components contained in the aggregated particles. As a result, a dispersion of toner mother particles is obtained. Thereafter, unnecessary substances (for example, a dispersant) are removed from the toner core dispersion, thereby producing toner cores.

(Shell Layer Formation)

For example, ion exchanged water is prepared as the liquid in which the toner cores and the shell material are put. Next, the pH of the liquid is adjusted to a specific pH for example with hydrochloric acid. The pH is preferably adjusted to at least 3 and no greater than 5 (to weakly acid) in order to promote shell layer formation.

The toner cores and a suspension of resin particles (liquid containing resin particles) are added to the liquid having the adjusted pH (for example, acidic aqueous medium). The resin forming the resin particles is a copolymer of at least one styrene-based monomer, at least one (meth)acrylic acid ester, and at least one alcoholic hydroxyl group-including monomer (for example, a copolymer of styrene, butyl acrylate, and 2-hydroxyethyl methacrylate). The suspension used herein preferably has a number average particle diameter of at least 25 nm and no greater than 40 nm in order to produce the toner having the basic configuration. At least one of a cross-linking agent (a specific example is divinylbenzene) and a material for synthesis of a thermosetting resin may be added to the liquid as needed.

The toner cores and the like may be added to the aqueous medium at room temperature or the aqueous medium at a temperature adjusted to a specific temperature. An appropriate additive amount of the shell material can be calculated based on the specific surface area of the toner core. A polymerization accelerator may be optionally added to the liquid in addition to the shell material and the like.

Preferably, the toner cores are highly dispersed in the liquid containing the shell material in order to cause the shell material (resin particles) to uniformly adhere to the surfaces of the toner cores. In order to highly disperse the toner cores in the liquid, a dispersant may be contained in the liquid or the liquid may be stirred using a high-power stirrer (for example, "Hivis Disper Mix" produced by PRIMIX Corporation).

Subsequently, the temperature of the liquid containing the shell material and the like is increased to a predetermined holding temperature (for example, at least 50° C. and no greater than 85° C.) at a predetermined ratio (for example, at least 0.1° C./min. and no greater than 3° C./min.) while the liquid is stirred. Further, the temperature of the liquid is kept at the holding temperature for a predetermined time period (for example, at least 30 minutes and no greater than four hours) while the liquid is stirred. Reaction (hardening of the shell layers) between the toner cores and the shell material (resin particles) is thought to progress during the time when the liquid is kept at the holding temperature (or when the temperature is increased). Chemical bonding of the shell material to the toner cores forms the shell layers. The shell material is thought to be melted in the liquid by heating to be hardened in the form of films. Films having no granular appearance are thought to be formed as shell layers when the shell material (resin particles) is melted completely and hardened in the form of films. By contrast, when the shell material (resin particles) is partially melted and hardened in the form of films, films having a form of two-dimensionally connected resin particles (film having granular appearance) are thought to be formed as shell layers. Formation of the shell layers on the surfaces of the toner cores in the liquid results in obtainment of a dispersion of toner mother particles.

As described above, when the resin particles are caused to adhere to the surfaces of the toner cores in the liquid and the liquid is heated, the resin particles are melt (or deformed) to be in the form of films. Alternatively, the resin particles may be formed into films by being heated in a drying process or receiving physical impact force in an external addition process.

The holding temperature is preferably less than the glass transition point (Tg) of the toner cores in order to inhibit elution of toner core components or deformation of the toner cores. Alternatively, the holding temperature may be set to be equal to or higher than the glass transition point (Tg) of the toner cores in order to intentionally cause deformation of the toner cores. The toner cores deform more readily in terms of shape as the holding temperature increases, thereby tending to yield toner mother particles that are more spherical. Desirably, the holding temperature is adjusted so as to give a desired shape of the toner mother particles. Reaction of the shell material at high temperature tends to result in formation of hard shell layers. The molecular weight of the shell layer can be controlled according to the holding temperature.

After shell layer formation as above, the dispersion of the toner mother particles is neutralized for example with sodium hydroxide. Subsequently, the dispersion of the toner mother particles is cooled for example to normal temperature (approximately 25°). The dispersion of the toner mother particles is then filtered for example using a Buchner funnel. Through filtration, the toner mother particles are separated (solid-liquid separation) from the liquid, thereby collecting a wet cake of the toner mother particles. Next, the resultant wet cake of the toner mother particles is washed. The toner mother particles that have been washed are then dried. Thereafter, as needed, an external additive is mixed with the toner mother particles using a mixer (for example, an FM mixer produced by Nippon Coke & Engineering Co., Ltd.) to cause the external additive to adhere to the surfaces of the toner mother particles. In a situation in which a spray dryer is used in the drying process, the drying process and the external addition process can be carried out simultaneously by spraying a dispersion of an external additive (for example, silica particles) toward the toner mother particles. Through the above, a toner containing multiple toner particles is produced.

Note that details and sequence of the toner production method described above may be changed freely according to for example desired configuration or characteristics of the toner. For example, the pH of the liquid (for example, the aqueous medium) may be adjusted before or after the shell material and the like (the shell material and the toner cores) are added to the liquid. The toner cores and the shell material may be added altogether at one time or separately. Furthermore, the liquid may be heated to the holding temperature before addition of the shell material and the like to the liquid. In a situation in which a material (for example, the shell material) is caused to react in the liquid, the material may be caused to react in the liquid for a predetermined time period after the material is added to the liquid. Alternatively, the material may be caused to react in the liquid through addition thereof to the liquid over a long period of time. Alternatively, the shell material may be added to the liquid as a single addition or may be divided up and added to the liquid as a plurality of additions. Any method can be employed for shell layer formation. The shell layer may for example be formed by any of an in-situ polymerization process, an in-liquid curing film coating process, and a coacervation process. The toner may be sifted after external addition. Note that non-essential steps may alternatively be omitted. In a situation in which an external additive is not caused to adhere to the surfaces of the toner mother particles (the external addition process is omitted), the toner mother particles and the toner particles are equivalent. The toner core material and the shell material are not limited to the respective compounds listed above (for example, monomers for resin synthesis). For example, a derivative of any of the compounds listed above may be used as the toner core material or the shell material. Alternatively, a prepolymer may be used in place of the monomer. The respective materials may be used in a solid state or a liquid state. For example, a powder of the material in the solid state may be used. A solution of the material (material in a liquid state dissolved in a solution) may be used. Alternatively, a dispersion of the material (liquid in which the material is dispersed) may be used. Preferably, a large number of toner particles are formed at the same time in order that the toner can be produced efficiently. Simultaneously produced toner particles are thought to have substantially the same configuration.

EXAMPLES

The following describes Examples of the present invention. Table 1 indicates toners A-J of examples, a reference example, and a comparative example (each are an electrostatic latent image developing toner).

TABLE 1

| | Styrene | Alcoholic hydroxyl group-including monomer | | | Butyl acrylate | Divinylbenzene | Methylol melamine |
|---|---|---|---|---|---|---|---|
| Toner | Amount [mL] | Type | Amount [mL] | Ratio [mass %] | Amount [mL] | Amount [mL] | Amount [mL] |
| A | 17.0 | HEMA | 1.0 | 4.8 | 2.0 | — | — |
| B | 18.0 | | 0.1 | 0.4 | | — | — |

TABLE 1-continued

| | Styrene | Alcoholic hydroxyl group-including monomer | | | Butyl acrylate | Divinylbenzene | Methylol melamine |
|---|---|---|---|---|---|---|---|
| Toner | Amount [mL] | Type | Amount [mL] | Ratio [mass %] | Amount [mL] | Amount [mL] | Amount [mL] |
| C | 14.0 | | 4.0 | 18.2 | | — | — |
| D | 18.0 | HEA | 1.0 | 4.7 | 1.0 | — | — |
| E | 18.0 | HPA | | 4.5 | 1.0 | — | — |
| F | 16.0 | HPMA | | 4.6 | 3.0 | — | — |
| G | 17.0 | HEMA | | 4.8 | 2.0 | — | 0.1 |
| H | 15.5 | HEMA | 1.0 | 4.9 | 3.0 | 0.5 | — |
| I | 11.0 | | 6.0 | 22.4 | | — | — |
| J | 17.0 | | — | — | | — | — |

Respective production methods of the toners A-J (each are an electrostatic latent image developing toner), evaluation methods, and evaluation results will be described below in order. In evaluations in which errors may occur, an evaluation value was calculated by calculating the arithmetic mean of an appropriate number of measured values in order to ensure that any errors were sufficiently small. Respective methods of measuring a glass transition point (Tg) and a softening point (Tm) are as follows unless otherwise stated.

<Tg Measuring Method>

A heat absorption curve (vertical axis: heat flow (DSC signals), horizontal axis: temperature) of a sample (for example, a resin) was plotted using a differential scanning calorimeter ("DSC-6220" produced by Seiko Instruments Inc.). Subsequently, the glass transition point (Tg) of the sample was read from the plotted heat absorption curve. The glass transition point (Tg) of the sample corresponds to a temperature at a point of change in specific heat on the heat absorption curve (i.e., an intersection point of an extrapolation of the base line and an extrapolation of the inclined portion of the curve).

<Tm Measuring Method>

A sample (for example, a resin) was placed in a capillary rheometer ("CFT-500D" produced by Shimadzu Corporation), and melt-flow of 1 $cm^3$ of the sample was caused using conditions of a die diameter of 1 mm, a plunger load of 20 $kg/cm^2$, and a heating ratio of 6° C./min. to plot an S-shaped curve of the sample (horizontal axis: temperature, vertical axis: stroke). The softening point (Tm) of the sample was read from the plotted S-shaped curve. The softening point (Tm) of the sample corresponds to a temperature (° C.) on the plotted S-shaped curve corresponding to a stroke value of "$(S_1+S_2)/2$", where $S_1$ represents a maximum stroke value and $S_2$ represents a base line stroke value at low temperatures.

[Production Method of Toner A]

(Preparation of Toner Cores)

An FM mixer (product of Nippon Coke & Engineering Co.) was used to mix 750 g of a low viscosity polyester resin (Tg: 38° C., Tm: 65° C.), 100 g of a medium viscosity polyester resin (Tg: 53° C., Tm: 84° C.), 150 g of a high viscosity polyester resin (Tg: 71° C. Tm: 120° C.), 55 g of a carnauba wax ("Carnauba Wax No. 1" produced by S. Kato & Co.), and 40 g of a colorant ("KET BLUE 111" produced by DIC Corporation, Phthalocyanine Blue) at a rotation speed of 2,400 rpm.

The resultant mixture was melt-kneaded using a two-axis extruder ("PCM-30" produced by Ikegai Corp.) under conditions of a material input ratio of 5 kg/hour, a shaft rotational speed of 160 rpm, and a temperature setting range (cylinder temperature) of at least 100° C. and no greater than 130° C. The resultant melt-kneaded substance was then cooled, and the cooled melt-kneaded substance was coarsely pulverized using a pulverizer ("Rotoplex (registered Japanese trademark)" produced by Hosokawa Micron Corporation). The coarsely pulverized product was finely pulverized using a jet mill ("Model-I Super Sonic Jet Mill" produced by Nippon Pneumatic Mfg.). Next, the finely pulverized product was classified using a classifier ("Elbow Jet EJ-LABO" produced by Nittetsu Mining Co., Ltd.). As a result, toner cores having a volume median diameter ($D_{50}$) of 6 μm were prepared.

(Preparation of Shell Material)

A 1-L three-necked flask equipped with a thermometer and a stirring impeller was set in a water bath at a temperature of 30° C. The flask was then charged with 875 mL of ion exchanged water and 75 mL of an anionic surfactant ("LATEMUL (registered Japanese trademark) WX" produced by Kao Corporation, component: sodium polyoxyethylene alkyl ether sulfate, solid concentration: 26% by mass). The internal temperature of the flask was then increased to 80° C. and kept at the temperature (80° C.) using the water bath. Subsequently, two liquids (first liquid and second liquid) were dripped separately into the flask contents at a temperature of 80° C. for over five hours. The first liquid was a mixed liquid of 17 mL of styrene, 1 mL of 2-hydroxyethyl methacrylate (HEMA), and 2 mL of butyl acrylate. The second liquid was a solution of 30 mL of ion exchanged water in which 0.5 g of potassium peroxodisulfate was dissolved. The internal temperature of the flask was kept at 80° C. for additional two hours for polymerization of the flask contents. Through the above, a suspension of resin fine particles (also referred to below as a suspension A) was yielded. The resin fine particles contained in the yielded suspension A had a number average particle diameter of 33 nm.

(Shell Layer Formation Process)

A 1-L three-necked flask equipped with a thermometer and a stirring impeller was set in a water bath and 300 mL of ion exchanged water was added to the flask. The internal temperature of the flask was then kept at 30° C. using the water bath. Next, dilute hydrochloric acid was added to the flask to adjust the pH of the flask content to 4. Subsequently, 150 mL of the suspension A was added to the flask.

Next, 300 g of the toner cores prepared through the above process were added to the flask and the flask contents were stirred for one hour at a rotational speed of 200 rpm. Then, 300 mL of ion exchanged water was added to the flask. Thereafter, the internal temperature of the flask was increased to 70° C. at a ratio of 1° C./min. while the flask contents was stirred at a rotational speed of 100 rpm.

Subsequently, the flask contents were stirred for 2 hours under conditions of a temperature of 70° C. and a rotational speed of 100 rpm.

Sodium hydroxide was added to the flask to adjust the pH of the flask contents to 7. The flask contents were then cooled to normal temperature (approximately 25° C.), thereby yielding a dispersion containing toner mother particles.

(Washing Process)

The dispersion of the toner mother particles yielded as above was filtered (solid-liquid separation) using a Buchner funnel to collect a wet cake of the toner mother particles. The wet cake of the toner mother particles was then re-dispersed in ion exchanged water. Furthermore, dispersion and filtration were repeated five times to wash the toner mother particles.

(Drying Process)

Next, the prepared toner mother particles were dispersed in an ethanol solution having a concentration of 50% by mass. Thus, a slurry of the toner mother particles was prepared. Subsequently, the toner mother particles in the slurry were dried under conditions of a hot air temperature of 45° C. and a flow ratio of 2 $m^3$/min. using a continuous type surface modifier ("Coatmizer (registered Japanese trademark)" produced by Freund Corporation). As a result, a powder of the toner mother particles was obtained.

(External Addition Process)

Subsequently, the prepared toner mother particles were subjected to external addition. Specifically, 100 parts by mass of the toner mother particles and 1.0 parts by mass of dry silica fine particles ("AEROSIL (registered Japanese trademark) REA90" produced by Nippon Aerosil Co., Ltd.) were mixed together for five minutes using a 10-L FM mixer (product of Nippon Coke & Engineering Co., Ltd.) to cause an external additive (silica particles) to adhere to the surfaces of the toner mother particles. Thereafter, the resultant powder was sifted using a 200 mesh sieve (opening 75 μm). As a result, a toner A containing multiple toner particles was produced.

[Production Method of Toner B]

The toner B was produced according to the same method as for the toner A in all aspects other than that 150 mL of a suspension B was used in place of 150 mL of the suspension A in the shell layer formation process. The suspension B was prepared according to the same method as for the suspension A in all aspects other than that a mixed liquid of 18 mL of styrene, 0.1 mL of 2-hydroxyethyl methacrylate (HEMA), and 2 mL of butyl acrylate was used as the first liquid in place of the mixed liquid of 17 mL of styrene, 1 mL of 2-hydroxyethyl methacrylate (HEMA), and 2 mL of butyl acrylate. Resin fine particles contained in the yielded suspension B had a number average particle diameter of 38 nm.

[Production Method of Toner C]

The toner C was produced according to the same method as for the toner A in all aspects other than that 150 mL of a suspension C was used in place of 150 mL of the suspension A in the shell layer formation process. The suspension C was prepared according to the same method as for the suspension A in all aspects other than that a mixed liquid of 14 mL of styrene, 4 mL of 2-hydroxyethyl methacrylate (HEMA), and 2 mL of butyl acrylate was used as the first liquid in place of the mixed liquid of 17 mL of styrene, 1 mL of 2-hydroxyethyl methacrylate (HEMA), and 2 mL of butyl acrylate.

The resin fine particles contained in the yielded suspension C had a number average particle diameter of 27 nm.

[Production Method of Toner D]

The toner D was produced according to the same method as for the toner A in all aspects other than that 150 mL of a suspension D was used in place of 150 mL of the suspension A in the shell layer formation process. The suspension D was prepared according to the same method as for the suspension A in all aspects other than that a mixed liquid of 18 mL of styrene, 1 mL of 2-hydroxyethyl acrylate (HEA), and 1 mL of butyl acrylate was used as the first liquid in place of the mixed liquid of 17 mL of styrene, 1 mL of 2-hydroxyethyl methacrylate (HEMA), and 2 mL of butyl acrylate.

Resin fine particles contained in the yielded suspension D had a number average particle diameter of 34 nm.

[Production Method of Toner E]

The toner E was produced according to the same method as for the toner A in all aspects other than that 150 mL of a suspension E was used in place of 150 mL of the suspension A in the shell layer formation process. The suspension E was prepared according to the same method as for the suspension A in all aspects other than that a mixed liquid of 18 mL of styrene, 1 mL of 2-hydroxy propyl acrylate (HPA), and 1 mL of butyl acrylate was used as the first liquid in place of the mixed liquid of 17 mL of styrene, 1 mL of 2-hydroxyethyl methacrylate (HEMA), and 2 mL of butyl acrylate. Resin fine particles contained in the yielded suspension E had a number average particle diameter of 31 nm.

[Production Method of Toner F]

The toner F was produced according to the same method as for the toner A in all aspects other than that 150 mL of a suspension F was used in place of 150 mL of the suspension A in the shell layer formation process. The suspension F was prepared according to the same method as for the suspension A in all aspects other than that a mixed liquid of 16 mL of styrene, 1 mL of 2-hydroxy propyl methacrylate (HPMA), and 3 mL of butyl acrylate was used as the first liquid in place of the mixed liquid of 17 mL of styrene, 1 mL of 2-hydroxyethyl methacrylate (HEMA), and 2 mL of butyl acrylate.

Resin fine particles contained in the yielded suspension F had a number average particle diameter of 39 nm.

[Production Method of Toner G]

The toner G was produced according to the same method as for the toner A in all aspects other than that 0.1 mL of an aqueous solution of an initial polymer of hexamethylol melamine ("MIRBANE (registered Japanese trademark) RESIN SM-607" produced by Showa Denko K.K., solid concentration: 80% by mass) was added to the flask as a shell material in addition to 150 mL of the suspension A in the shell layer formation process.

[Production Method of Toner H]

The toner H was produced according to the same method as for the toner A in all aspects other than that 150 mL of a suspension H was used in place of 150 mL of the suspension A in the shell layer formation process. The suspension H was prepared according to the same method as for the suspension A in all aspects other than that a mixed liquid of 15.5 mL of styrene, 1 mL of 2-hydroxyethyl methacrylate (HEMA), 3 mL of butyl acrylate, and 0.5 mL of divinylbenzene was used as the first liquid in place of the mixed liquid of 17 mL of styrene, 1 mL of 2-hydroxyethyl methacrylate (HEMA), and 2 mL of butyl acrylate. Resin fine particles contained in the yielded suspension H had a number average particle diameter of 39 nm.

[Production Method of Toner I]

The toner I was produced according to the same method as for the toner A in all aspects other than that 150 mL of a suspension I was used in place of 150 mL of the suspension A in the shell layer formation process. The suspension I was prepared according to the same method as for the suspension A in all aspects other than that a mixed liquid of 11 mL of styrene, 6 mL of 2-hydroxyethyl methacrylate (HEMA), and 3 mL of butyl acrylate was used as the first liquid in place of the mixed liquid of 17 mL of styrene, 1 mL of 2-hydroxyethyl methacrylate (HEMA), and 2 mL of butyl acrylate. Resin fine particles contained in the yielded suspension I had a number average particle diameter of 24 nm.

[Production Method of Toner J]

The toner J was produced according to the same method as for the toner A in all aspects other than that 150 mL of a suspension J was used in place of 150 mL of the suspension A in the shell layer formation process. The suspension J was prepared according to the same method as for the suspension A in all aspects other than that a mixed liquid of 17 mL of styrene and 3 mL of butyl acrylate was used as the first liquid in place of the mixed liquid of 17 mL of styrene, 1 mL of 2-hydroxyethyl methacrylate (HEMA), and 2 mL of butyl acrylate. Resin fine particles contained in the yielded suspension J had a number average particle diameter of 52 nm.

Table 1 indicates measurement results of the ratio (unit: % by mass) of the specific hydroxyl group-including unit in the specific hydroxyl group-including resin forming the shell layers in each of the toners A-J produced as above. For example, the specific hydroxyl group-including unit ratio in the toner A was 4.8% by mass. No specific hydroxyl group-including resin (resin including a repeating unit having an alcoholic hydroxyl group) was contained in the shell layers of the toner J. The specific hydroxyl group-including unit ratio was measured by the following measuring method.

(Specific Hydroxyl Group containing Unit Ratio)

The ratio of the specific hydroxyl group-including unit (repeating unit derived from an alcoholic hydroxyl group-including monomer) relative to all repeating units in the specific hydroxyl group-including resin forming the shell layer is measured through quantitative analysis by GC/MS method. Measuring apparatuses used were a gas chromatograph mass spectrometer ("GCMS-QP2010 Ultra" produced by Shimadzu Corporation) and a multi-shot pyrolyzer ("PY-3030D" produced by Frontier Laboratories Ltd.). A column used was a metal capillary column ("Ultra ALLOY (registered Japanese trademark)-5 (MS/HT)" produced by Frontier Laboratories Ltd., inner diameter: 0.25 mm, film thickness: 0.25 m, length: 30 m). The following measurement conditions were used.

<Conditions for GC/MS>

Thermal decomposition temperature: Heating furnace of "600° C.", Interface portion of "400° C."

Heating condition: 40° C. (0 minute) to 320° C. (after 10 minutes) at 14° C./min.

Carrier gas: Helium (He) gas (linear velocity: 36.3 cm/min.).

Column head pressure: 53.5 kPa.

Injection mode: Split injection (split ratio of 1:200).

Carrier flow rate: Total flow ratio of "204 mL/min., Column flow ratio of "1 mL/min., Purge flow ratio of "3 mL/min."

Component identification was carried out through analysis of each of measured mass spectra, and the amount (specifically, mass) of a repeating unit in the specific hydroxyl group-including resin was measured based on an area of a peak unique to the repeating unit in the resin in the measured chromatogram. A standard substance was used for the quantitative analysis.

[Evaluation Method]

Each sample (toners A-J) was evaluated according to the following methods.

(High-Temperature Preservability)

A 20-mL polyethylene container was charged with 2 g of a sample (toner) and allowed to stand still in a thermostatic oven set at 60° C. for three hours. Through the above, an evaluation toner was prepared in the container.

The evaluation toner was then placed on a 100 mesh sieve (opening: 150 μm) of a known mass. The mass of the evaluation toner on the sieve (mass of toner prior to sifting) was obtained by measuring the mass of the sieve containing the evaluation toner. Subsequently, the sieve was set in a powder tester (product of Hosokawa Micron Corporation) and caused to vibrate in accordance with a manual of the powder tester at a rheostat level of 5 for 30 seconds. After the sifting, the mass of the toner remaining on the sieve (mass of toner after sifting) was measured by measuring the mass of the sieve containing residual toner. The degree of aggregation (unit: % by mass) of the sample (toner) was calculated based on the following equation.

Degree of aggregation=100×(mass of toner after sifting)/(mass of toner prior to sifting)

A toner having a degree of aggregation of no greater than 50% by mass was evaluated as good (Good), and a toner having a degree of aggregation of greater than 50% by mass was evaluated as poor (Poor).

(Low-Temperature Fixability)

A developer carrier (carrier for "TASKalfa5550ci" produced by KYOCERA

Document Solutions Inc.) and a sample (toner) were mixed together for 30 minutes using a ball mill to prepare an evaluation developer (two-component developer). The ratio of the sample (toner) in the evaluation developer was 12% by mass.

A color printer (evaluation apparatus that was "FS-C5250DN" produced by KYOCERA Document Solutions Inc. and modified so as to be capable of changing a fixing temperature) was used as an evaluation apparatus. The evaluation developer prepared as above was loaded into a developing device of the evaluation apparatus and a sample (toner for replenishment) was loaded into a toner container of the valuation apparatus.

A solid image having a size of 25 mm by 25 mm was formed on paper having a weight of 90 g/m$^2$ (A4-size evaluation paper) using conditions of a linear velocity of 200 mm/sec. and a toner applied amount of 1.0 mg/cm$^2$. Next, the paper having the image formed thereon was passed through the fixing device. The fixing temperature was set within a range from 100° C. to 200° C. Specifically, a minimum temperature at which the toner (solid image) could be fixed to the paper (lowest fixing temperature) was measured by gradually increasing the fixing temperature of the fixing device from 100° C.

Whether or not the toner was fixed in the measurement of the lowest fixing temperature was confirmed by a fold-rubbing test described below. Specifically, the paper was folded in half such that a surface on which the image was formed was folded inward, and a 1-kg weight covered with cloth was rubbed back and forth on the fold five times. Next, the paper was opened up and a fold portion (i.e., a portion to which the solid image was formed) was observed. A length of peeling of the toner (peeling length) in the folded portion was measured then. A minimum temperature was determined to be a lowest fixing temperature among fixing temperatures for which the peeling length was less than 1 mm.

A lowest fixing temperature of no greater than 160° C. was evaluated as good (Good) and a lowest fixing temperature of greater than 160° C. was evaluated as poor (Poor).

(Durability)

An evaluation developer (two-component developer) was prepared by the same method as for that used in the evaluation of low-temperature fixability. A color multifunction peripheral ("TASKalfa5550ci" produced by KYOCERA Document Solutions Inc.) was used as an evaluation apparatus. The evaluation developer was loaded into a developing device of the evaluation apparatus, and a sample (toner for replenishment) was loaded into a toner container of the evaluation apparatus. Further, a voltage between a development sleeve and a magnet roll of the evaluation apparatus was adjusted in a range from 200 V to 300 V so as to set the initial image density (measuring apparatus: "SpectroEye (registered Japanese trademark)" produced by X-Rite Inc.) to be in a range from 1.0 to 1.2.

A printing durability test was carried out by continuous printing of 10,000 pieces of paper at a printing ratio of 5% using the evaluation apparatus in an environment of a temperature of 20° C. and a humidity of 60% RH.

After the printing durability test, a portion of a sample (toner) that had scattered in the developing device of the evaluation apparatus was all collected. The mass of the collected toner was measured and the measured mass of the toner (amount of scattering toner) was evaluated in accordance with the following criteria.

An amount of scattering toner of no greater than 100 mg was evaluated as good (Good), and an amount of scattering toner of greater than 100 mg was evaluated as poor (Poor).

The developer was taken out from the developing device of the evaluation apparatus after the printing durability test and the charge amount of the toner in the developer was measured. The charge amount of the toner in the developer was measured under the following conditions using a Q/m meter ("MODEL 210HS-1" produced by TREK, INC.).

<Charge amount Measuring Method for Toner in Developer>

A developer was loaded into a measurement cell of the Q/m meter, and only toner in the loaded developer was sucked through a sieve for 10 seconds. A charge amount (unit: μC/g) of the toner in the developer was calculated based on an expression "(total charge amount (unit: μC) of sucked toner)/(mass (unit: g) of sucked toner).

A charge amount of the toner in the developer after the printing durability test of at least 10 μC/g and no greater than 27 μC/g was evaluated as good (Good), and a charge amount thereof of less than 10 μC/g or greater than 27 μC/g was evaluated as poor (Poor).

Furthermore, a ratio (unit: % by mass) of oppositely charged toner contained in the toner in the developer on the developing sleeve was measured using a particle size and electrostatic charge distribution analyzer ("E-spart Analyzer (registered Japanese trademark) EST-3" produced by Hosokawa Micron Corporation) after the printing durability test.

A ratio of oppositely charged toner of no greater than 1.00% by mass was evaluated as good (Good), and a ratio thereof of greater than 1.00% by mass was evaluated as poor (Poor).

Whether or not toner adhered to a photosensitive drum was evaluated in the printing durability test. Specifically, a formed solid image in which no dash mark was observed was evaluated as good (Good) and a formed solid image in which a dash mark was observed was evaluated as poor (Poor). The dash mark is referred to as an image defect that may be caused due to adhesion of toner to the surface of a photosensitive drum.

(Transfer Efficiency)

An evaluation developer (two-component developer) was prepared according to the same method as for that used in the evaluation of low-temperature fixability. A color multifunction peripheral ("TASKalfa5550ci" produced by KYOCERA Document Solutions Inc.) was used as an evaluation apparatus. The evaluation developer was loaded into a developing device of the valuation apparatus, and a sample (toner for replenishment) was loaded into a toner container of the evaluation apparatus.

Continuous printing at a printing ratio of 5% was carried out on 1,000 pieces of recording mediums (A4-size printing paper) using the evaluation apparatus in an environment of a temperature of 32° C. and a humidity of 80% RH. Thereafter, transfer efficiency was measured.

Respective masses of consumed toner and collected toner were measured after the 1,000-piece continuous printing in measurement of transfer efficiency. Then, transfer efficiency (unit: % by mass) was calculated based on the following equation.

Note that the consumed toner refers to a portion of a sample (toner) that was loaded in the toner container and discharged from the toner container. The collected toner refers to a portion of the consumed toner that was not transferred to the recording medium.

$$\text{Transfer efficiency}=100\times((\text{mass of consumed toner})-(\text{mass of collected toner}))/(\text{mass of consumed toner})$$

A transfer efficiency of at least 85% by mass was evaluated as very good (Very good). A transfer efficiency of at least 70% by mass and less than 85% by mass was evaluated as good (Good). A transfer efficiency of less than 70% by mass was evaluated as poor (Poor).

(Charge Decay Characteristic)

The charge decay constant of a sample (toner) was measured in accordance with Japan Industrial Standard (JIS) C 61340-2-1-2006 using an electrostatic dissipation measuring device ("NS-D100" produced by Nano Seeds Corporation). The following describes the method for measuring the charge decay constant of a toner in detail.

A sample (toner) was placed in a measurement cell. The measurement cell was a metal cell having a recess with an internal diameter of 10 mm and a depth of 1 mm. The sample was loaded into the recess of the cell, pressing on the sample from above using slide glass. Any of the sample that overflowed from the cell was removed by moving the slide glass back and forth on the surface of the cell. At least 0.04 g and no greater than 0.06 g of the sample was loaded into the cell.

Thereafter, the measurement cell was grounded and placed in the electrostatic diffusivity measuring device. Ions were then supplied to the sample through corona discharge to charge the sample. The time period for charging was 0.5 seconds. After elapse of 0.7 seconds from completion of the corona discharge, the surface potential of the sample was measured continuously. The charge decay constant (charge decay rate) a was calculated based on the measured surface potential and an equation "$V=V_0\exp(-\alpha\sqrt{t})$". In the equation, V represents a surface potential [V], $V_0$ represents an initial surface potential [V], and t represents a decay time [second].

A charge decay constant of no greater than 0.02 was evaluated as very good (Very good). A charge decay constant of greater than 0.02 and no greater than 0.03 was evaluated as good (Good). A charge decay constant of greater than 0.03 was evaluated as poor (Poor).

[Evaluation Results]

Tables 2 and 3 indicate evaluation results of the toners A-J. Table 2 indicates respective evaluation results of high-temperature preservability (degree of aggregation), low-temperature fixability (lowest fixing temperature), and charge decay characteristic (charge decay constant). Table 3 indicates respective evaluation results of durability (amount of scattering toner, charge amount, ratio of oppositely charged toner, and presence or absence of drum adhesion) and transfer efficiency. Note that "800 pieces" for evaluation results of drum adhesion in Table 3 refers to a dash mark being observed after 800-piece printing. Also, "-" for evaluation results of transfer efficiency in Table 3 refers to measurement being disabled due to occurrence of drum adhesion.

TABLE 2

| | Toner | High-temperature preservability [% by mass] | Lowest fixing temperature [° C.] | Charge decay constant |
|---|---|---|---|---|
| Example 1 | A | 32 | 148 | 0.01 (Very good) |
| Example 2 | B | 38 | 146 | 0.01 (Very good) |
| Example 3 | C | 32 | 147 | 0.01 (Very good) |
| Example 4 | D | 40 | 147 | 0.01 (Very good) |
| Example 5 | E | 46 | 148 | 0.01 (Very good) |
| Example 6 | F | 42 | 142 | 0.02 (Very good) |
| Example 7 | G | 12 | 153 | 0.01 (Very good) |
| Example 8 | H | 25 | 149 | 0.02 (Very good) |
| Reference Example 1 | I | 36 | 146 | 0.03 |
| Comparative Example 1 | J | 41 | 145 | — |

TABLE 3

| | | 20° C. and 60% RH After 10,000-piece printing | | | | 32° C. and 80% RH |
|---|---|---|---|---|---|---|
| | Toner | Scattering toner [mg] | Charge amount [μC/g] | Mass of oppositely charged toner [% by mass] | Drum adhesion | After 1,000-piece printing Transfer efficiency [% by mass] |
| Example 1 | A | 42 | 23 | 0.15 | Good | 95 (Very good) |
| Example 2 | B | 86 | 17 | 0.82 | Good | 97 (Very good) |
| Example 3 | C | 32 | 24 | 0.14 | Good | 87 (Very good) |
| Example 4 | D | 56 | 14 | 0.32 | Good | 88 (Very good) |
| Example 5 | E | 82 | 12 | 0.86 | Good | 90 (Very good) |
| Example 6 | F | 67 | 16 | 0.80 | Good | 92 (Very good) |
| Example 7 | G | 83 | 13 | 0.85 | Good | 97 (Very good) |
| Example 8 | H | 32 | 25 | 0.11 | Good | 85 (Very good) |
| Reference Example 1 | I | 35 | 20 | 0.52 | Good | 75 |
| Comparative Example 1 | J | 350 (Poor) | 8 (Poor) | 2.40 (Poor) | Poor (800 pieces) | — |

The toners A-H (toners of Examples 1-8) each had the basic configuration. Specifically, shell layers of the respective toners of Examples 1-8 were substantially formed from a resin (specific hydroxyl group-including resin) having a repeating unit including an alcoholic hydroxyl group (specific hydroxyl group-including unit). The toners of Examples 1-8 each had a ratio of the specific hydroxyl group-including unit relative to all repeating units in the specific hydroxyl group-including resin of at least 0.1% by mass and no greater than 20% by mass. The shell layers of the toners of Examples 1-8 each had a thickness of at least 1 nm and no greater than 30 nm.

As indicated in Table 2, the toners of Examples 1-8 each were excellent in high-temperature preservability, low-temperature fixability, and charge decay characteristic. Furthermore, as indicated in Table 3, the toners of Examples 1-8 each were excellent in durability and transfer efficiency. The toners of Examples 1-8 each were positively charged to a sufficient level even in a high-temperature and high-humidity environment, with a result that a high-quality image could be formed for an extended period of term.

The toners of Examples 1-8 each were more excellent in transfer efficiency than the toner I (toner of Reference Example 1). The ratio of the specific hydroxyl group-including unit in the toner I was greater than 20% by mass.

The toner J (toner of Comparative Example 1) was inferior in durability to the toners A-H (toners of Examples 1-8). The reason therefor is inferred from the shell layers containing no specific hydroxyl group-including resin in the toner J.

INDUSTRIAL APPLICABILITY

The electrostatic latent image developing toner according to the present invention can be used for image formation for example using a copier, a printer, or a multifunction peripheral.

The invention claimed is:

1. An electrostatic latent image developing toner comprising a plurality of toner particles each including a core containing a binder resin and a shell layer disposed over a surface of the core, wherein the core contains a polyester resin as the binder resin, the shell layer is substantially formed from a resin having at least one repeating unit derived from a styrene-based monomer, at least one repeating unit derived from (meth)acrylic acid ester, and at least one repeating unit including an alcoholic hydroxyl group, a ratio of the repeating unit including the alcoholic hydroxyl group relative to all repeating units in the resin substantially forming the shell layer is at least 0.1% by mass and no greater than 20% by mass, and the resin having the alcoholic hydroxyl group included in the shell layer and the polyester resin contained in the core are ester bonded to each other.

2. The electrostatic latent image developing toner according to claim 1, wherein the at least one repeating unit including the alcoholic hydroxyl group includes a repeating unit derived from 2-hydroxyethyl acrylate, 2-hydroxy propyl acrylate, 2-hydroxyethyl methacrylate, or 2-hydroxy propyl methacrylate.

3. The electrostatic latent image developing toner according to claim 1, wherein the ratio of the repeating unit including the alcoholic hydroxyl group relative to all the repeating units in the resin substantially forming the shell layer is at least 5% by mass and no greater than 10% by mass.

4. The electrostatic latent image developing toner according to claim 1, wherein the shell layer has a thickness of at least 1 nm and no greater than 30 nm.

5. An electrostatic latent image developing toner comprising a plurality of toner particles each including a core containing a binder resin and a shell layer disposed over a surface of the core, wherein the core contains a polyester resin as the binder resin, the shell layer is substantially formed from a resin having at least one repeating unit derived from a styrene-based monomer, at least one repeating unit derived from (meth)acrylic acid ester, and at least one repeating unit including an alcoholic hydroxyl group, a ratio of the repeating unit including the alcoholic hydroxyl group relative to all repeating units in the resin substantially forming the shell layer is at least 0.1% by mass and no greater than 20% by mass, and the shell layer is a polymer of styrene, 2-hydroxyethyl methacrylate, and butyl acrylate at a volume ratio of 17:1:2.

6. An electrostatic latent image developing toner comprising a plurality of toner particles each including a core containing a binder resin and a shell layer disposed over a surface of the core, wherein the core contains a polyester resin as the binder resin, the shell layer is substantially formed from a resin having at least one repeating unit derived from a styrene-based monomer, at least one repeating unit derived from (meth)acrylic acid ester, and at least one repeating unit including an alcoholic hydroxyl group, a ratio of the repeating unit including the alcoholic hydroxyl group relative to all repeating units in the resin substantially forming the shell layer is at least 0.1% by mass and no greater than 20% by mass, and the shell layer is a polymer of styrene, 2-hydroxyethyl methacrylate, and butyl acrylate at a volume ratio of 14:4:2.

7. The electrostatic latent image developing toner according to claim 1, wherein the cores constitute a pulverized product of a melt-kneaded substance containing the binder resin.

* * * * *